United States Patent [19]

Delery

[11] 4,150,500

[45] Apr. 24, 1979

[54] MOLDED BOOT

[75] Inventor: Marc G. Delery, Caluire, France

[73] Assignee: Trappeur, Saint Laurent Du Pont, France

[21] Appl. No.: 862,280

[22] Filed: Dec. 19, 1977

[30] Foreign Application Priority Data

Dec. 20, 1976 [FR] France ..... 76 38997

[51] Int. Cl.[2] ..... A43B 5/04; A43B 11/00; A43C 11/00

[52] U.S. Cl. ..... 36/117; 36/50; 24/71 SK

[58] Field of Search ..... 36/117, 118, 119, 120, 36/121, 50; 24/68 SK, 69 SK, 70 SK, 71 SK, 73 GC, 81 SK

[56] References Cited

U.S. PATENT DOCUMENTS

| | | | |
|---|---|---|---|
| 3,204,307 | 9/1965 | Dunn | 36/50 |
| 4,020,571 | 5/1977 | Olivieri | 36/50 |

FOREIGN PATENT DOCUMENTS

| | | | |
|---|---|---|---|
| 248918 | 8/1966 | Austria | 24/68 SK |
| 2658453 | 7/1977 | Fed. Rep. of Germany | 36/50 |
| 1330758 | 5/1963 | France | 36/50 |
| 1485 | 11/1889 | Switzerland | 24/71 SK |

*Primary Examiner*—Patrick D. Lawson
*Attorney, Agent, or Firm*—Arnold, White & Durkee

[57] ABSTRACT

A molded plastics material boot, for example a ski boot, in which a rigid sole has a rigid shell upper molded integrally therewith, the rigid shell having first and second relatively movable portions, and at least one closure element for clamping the portions in a closed position on a wearers foot. Each of the closure elements is in the form of a closed loop of flexible cable the first ends being connected to one of the molded portions of the shell upper, and the lever being mounted on the second end of the loop in a pivotable manner and engageable with a fixed seat molded onto the second portion, the end of the lever being engageable in the fixed seat and being pivotable after engagement to effect tightening of the loop.

13 Claims, 11 Drawing Figures

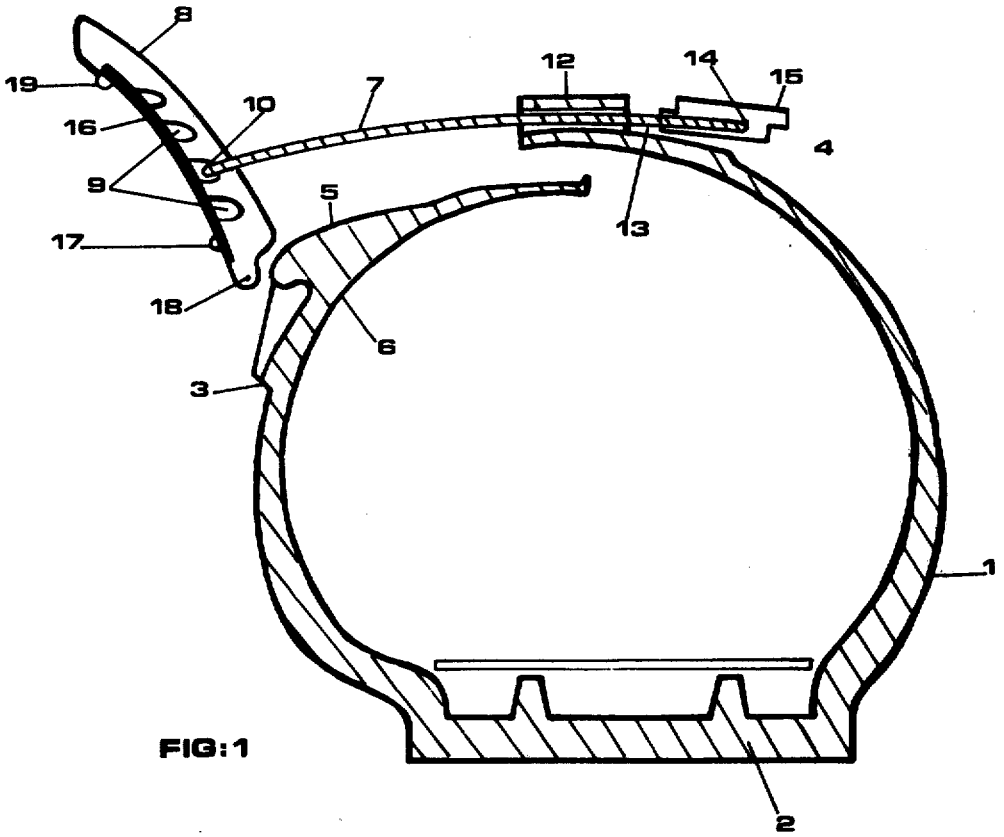
FIG:1
FIG:3
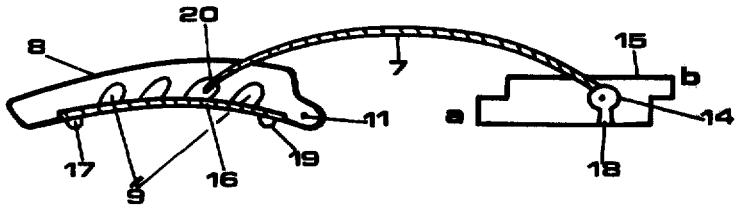

MOLDED BOOT

The invention relates to boots, such as ski boots, mountain boots or the like, formed by injection-molding from a synthetic material, in particular a thermoplastic material.

Such boots are of the type including a shell upper mounted on a sole, the shell upper being formed with first and second relatively movable portions. These relatively movable portions may take the form of flaps or a cover part of the shell upper. Conventionally such shell uppers are secured together on a wearer's foot by closure elements in the form of buckles and consist, for each closure element, of a buckle and a lever.

According to this well known method of closure, the buckle and the lever are fixed to the shell upper on one side and the other either of the cut-open part of the boot or of the cover part, so that they can be put in place and released. When putting on the boot, these elements are joined together to ensure closure.

The lever, which is usually in the shape of a hook, in general carries a number of teeth which make it possible to regulate the tightness of the boot, and it is pivotably mounted on a support or base which is fixed on the shell portion. In most cases, the fixing of the base supporting the lever is effected by riveting.

Generally, the closure of such a buckle is effected by passing the lever through the inside of a buckle, positioning the latter in the selected tooth of the lever according to the desired tightness and then pivoting the lever back towards the outside in order to close the boot. An arrangement of this type, described for example in French Patent No. 1,330,758 gives good results and is used on the majority of present day ski boots. It has, however, a number of both technical and economic disadvantages.

This type of buckle is in fact very costly since it requires a long, meticulous and complex assembly of the levers on the shell portion. Furthermore, the lever and its base form a very rigid unit and, in the case of impacts or laterally exerted stresses, this sometimes causes the lever to break in the region of the pivot point. In this case, the replacement requires a meticulous operation which, of necessity, has to be carried out by a specialist. Moreover, it has been found that, in the course of use, the levers sometimes tend to open due to the stresses exerted and the curvature of the boots. Finally, since the bases of the levers are in general riveted to the boot, it is a long and delicate operation to mount them and this must be carried out by specialist personnel, which significantly increases the manufacturing costs. Moreover, riveting involves in certain cases a risk of leak-tightness defects when it is carried out poorly.

To facilitate the mounting of the levers on the shell, it has been proposed to eliminate riveting and to replace this operation by fitting the base supporting the lever by force into a complementary element which is provided during molding. This mode of operation is, however, not satisfactory since it significantly complicates the molding operation of the boot and/or provides inadequate resistance to pulling-out.

It is now proposed, according to the present invention, to provide a molded plastics material boot comprising, in combination a rigid sole; a rigid shell upper integral with said sole; first and second relatively movable portions of said shell upper enabling said shell upper to be closed on a wearer's foot; at least one closure element for clamping said portions in a closed position, each said closure element comprising:

(i) a closed loop having first and second ends, the first end being connected to said first portion;

(ii) a lever pivotally mounted on the second end of the loop;

(iii) a fixed seat molded onto said second portion; and (iv) an end on said lever engageable in said fixed seat, said lever being pivotable after engagement in said seat effective to tighten said loop.

It has been found that such a structure overcomes the disadvantages of the earlier devices. The boot according to the invention is significantly simpler and more economic and efficient and, above all, does not require a fixing operation of the closure elements by riveting or the like. Moreover, it does not in any way complicate the molding or injection-molding of the said boot.

In the following part of the description, the invention will be described in its essentials in an application to injection-molded ski boots in which the shell is opened by two flaps on the upper. It is, however, stated expressly that this is not a limitation and that the invention can also be applied to other types of boots, for example those which are opened by a pivoting cover portion on the front or on the back.

Advantageously the loop is in the form of a flexible cable, although it could be made of rigid or semi-rigid wires.

In a particular embodiment, the lever has on its support face a plurality of parallel horizontal grooves which are intended to receive a transverse portion of the loop, the holding of this transverse portion on a respective groove being achieved by means of a flexible cover plate engaged over said grooves.

Advantageously, this cover is relatively thin, is made of metal and covers the lever over its entire length and is fixed to at least one end of the lever. This prevents the transverse portion of the loop dropping out when the boot is open and still permits ready displacement of the loop relative to the different grooves located in the lever, when it is desired to modify the tightening force.

Although sometimes a single element forming a seat can be suitable, it is possible to provide several mutually offset seat elements on the shell of the boot, in order to widen the ranges of controlling the tightening force.

In order that the invention will be better understood the following description is given, merely by way of non-limiting example, reference being made to the accompanying drawings, in which:

FIGS. 1 and 11 are a diagrammatic cross-section through one embodiment of boot according to the invention.

FIG. 3 is a side elevation of the closure element of FIG. 2 in an alternative position;

Figure 6:
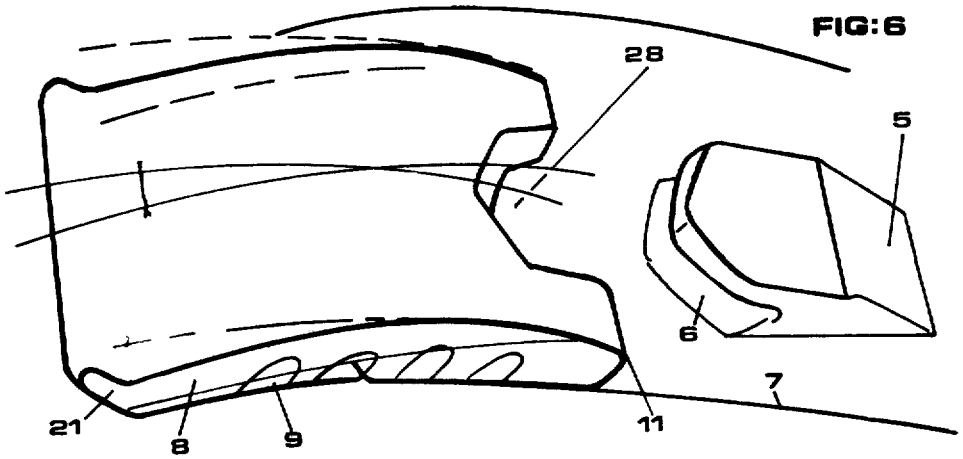
Figure 7:
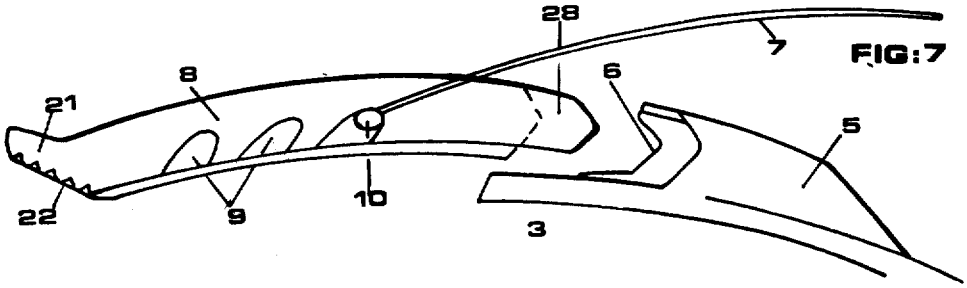
Figure 8:
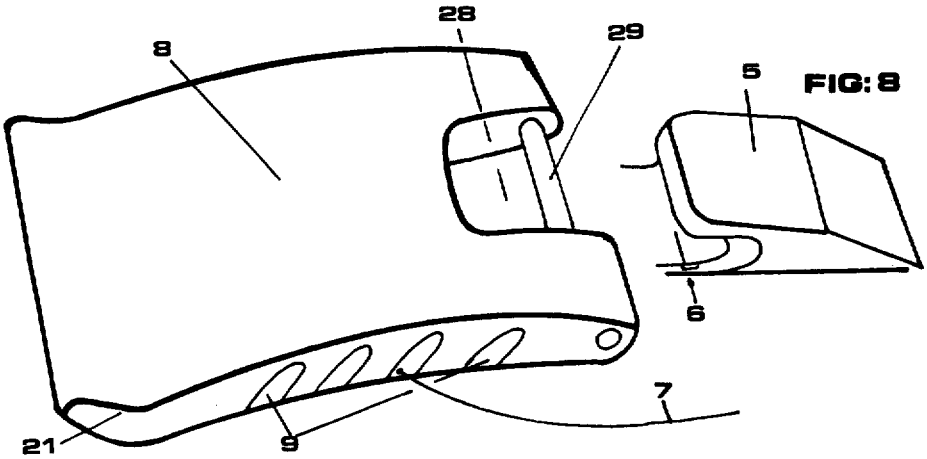
Figure 9:
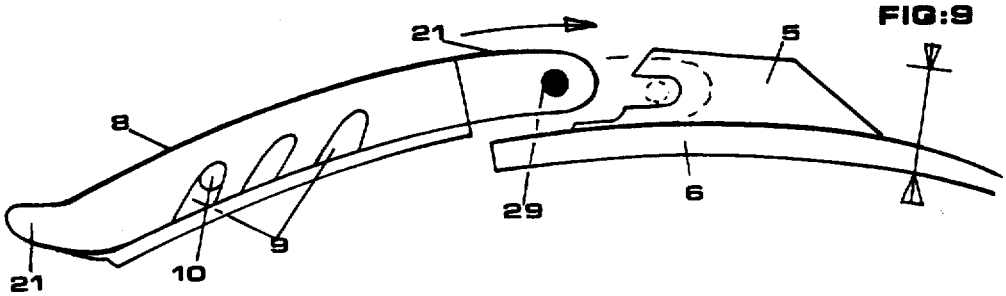
Figure 10:
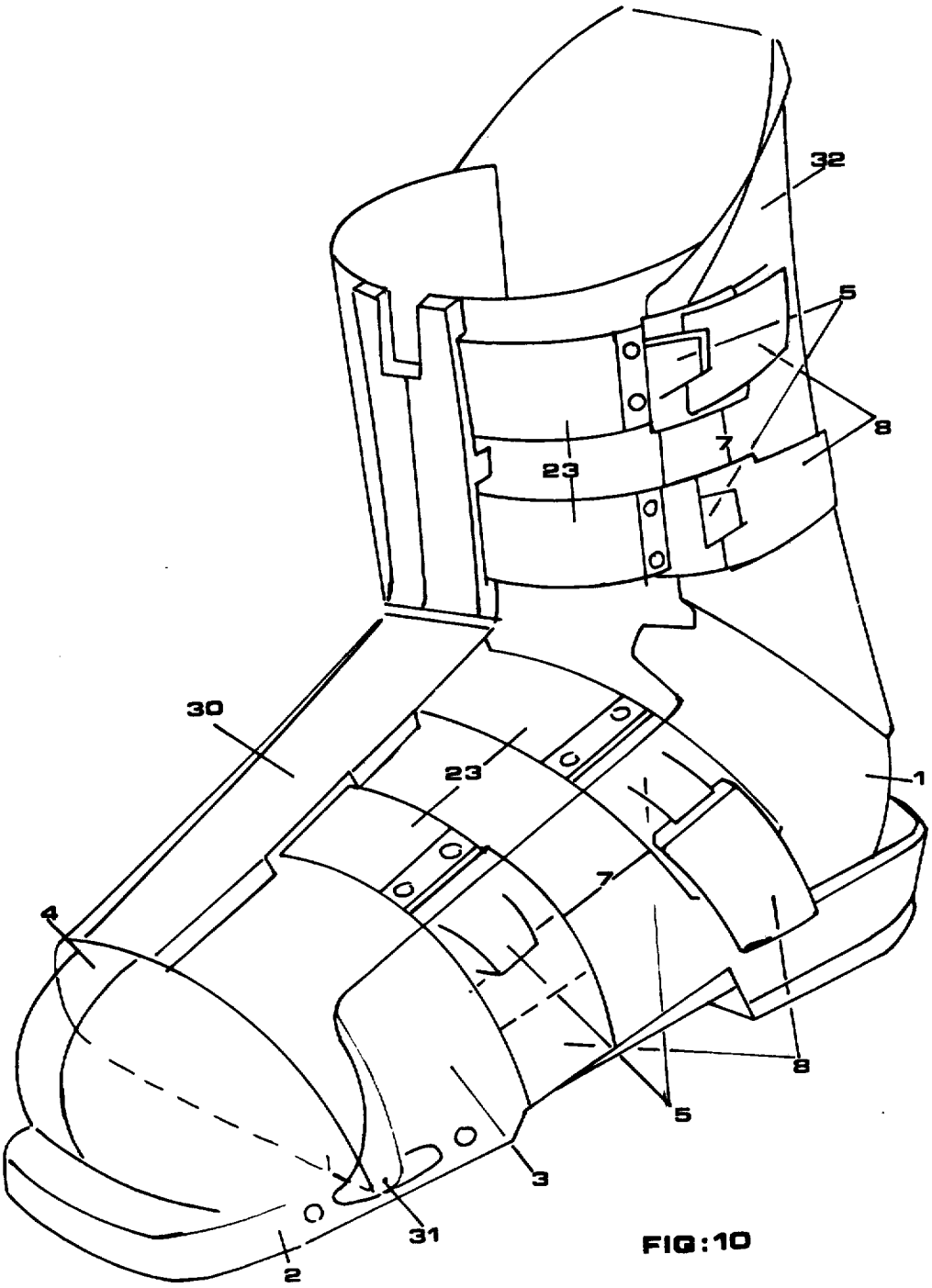

FIGS. 6 and 8 show in perspective two further forms of loop and lever, while FIGS. 7 and 9 are side elevations of the constructions of FIGS. 6 and 8 respectively; and FIG. 10 is a perspective view of a further construction of boot according to the invention.

In the various Figures like parts have been indicated by like reference numerals.

In FIG. 1 the shoe consists of a shell upper 1 injection-molded from plastic material, for example of Rilsan type polyamide 11, of polyurethane of high SHORE hardness or of high-density polyethylene or of another rigid thermoplastic material, integrally molded with a sole 2. The shell upper 1 is molded with relatively movable portions in the form of first and second flaps 4 and 3 which overlap one another and allow the foot to be introduced. A seat 5 is molded onto the second flap 3, during molding of the upper, the seat having a horizontal female notch 6.

A flexible cable or a steel rope closed loop 7 has pivotally mounted thereon, a lever 8 of plastic or other material which is rigid and very resistant to temperature and abrasion, for example of polyacetal, polycarbonate or ABS resin, which lever has, spaced apart along its length, a plurality of parallel horizontal grooves 9 which are intended to receive the transverse end portion 10 of the loop 7; the lower end 11 of this lever 8 is tapered and rounded to form a lip which is of co-operating shape to the contours of the notch 6.

Integrally formed with the first portion 4 during molding is a lug 12 which is located opposite seat 5, and is provided with a channel 13, intended to permit the passage of the loop 7, passing horizontally from one side to the other of the lug. The other transverse end portion 14 of loop 7 engages pivotally in a transverse slit 18 formed in a movable stop member 15. The stop has two end portions A and B which are spaced different distances from the slit 18 and can be selectively arranged to abut or even engage in the passage 13 of the lug 12. Thus depending on which way the stop is turned a change in the effective length of the loop 7 can be made.

In order to hold the transverse end portion 10 of loop 7 in one of grooves 9, a thin metal plate is fixed by means of rivets 17 and 19 on the outer face of the lever 8. U-shaped seamless stainless steel tubes 20 are shrunk onto the cable 7 at the two transverse end portions 10 and 14, so as to allow the lever 8 and the movable stop 15 to pivot about the ends 10 and 14 respectively of the cable. A gripping lip 21 is provided on the lever 8 opposite the end 11, which lip is intended to facilitate gripping of the lever by the skier; in an advantageous form, the inner face of the lever 8 has corrugations 22 opposite the lip 21.

Figure 2:
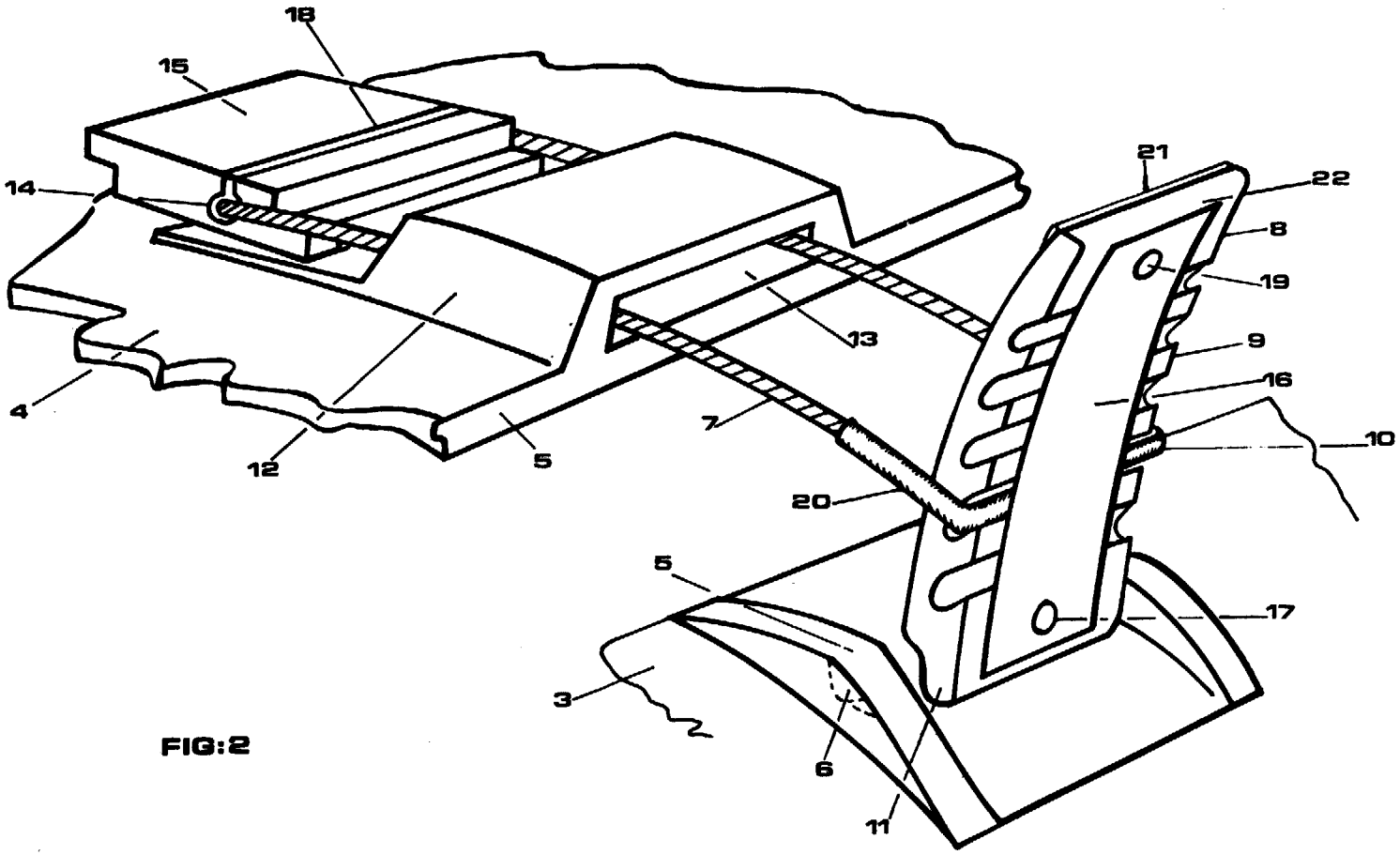
FIG. 2 is a fragmentary perspective view of the closure element of the boot of FIG. 1 at the moment of closing the boot.
Figure 4:
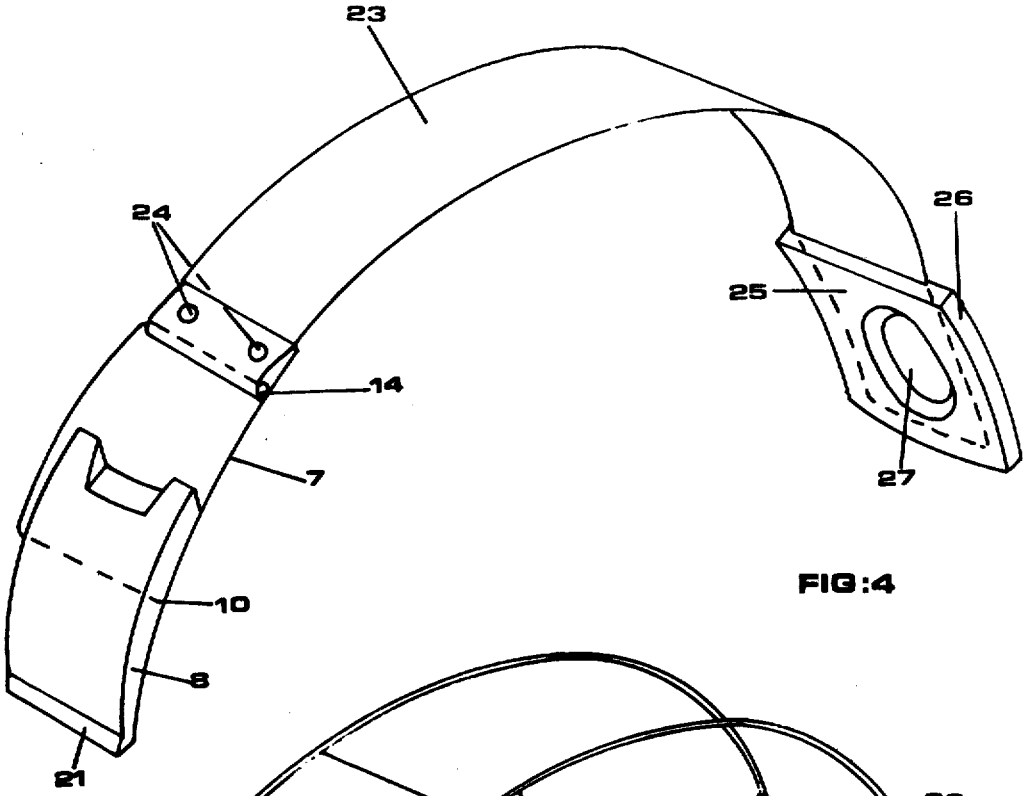
FIGS. 4 and 5 show, in perspective, two further embodiments of the loop and lever.
Figure 5:
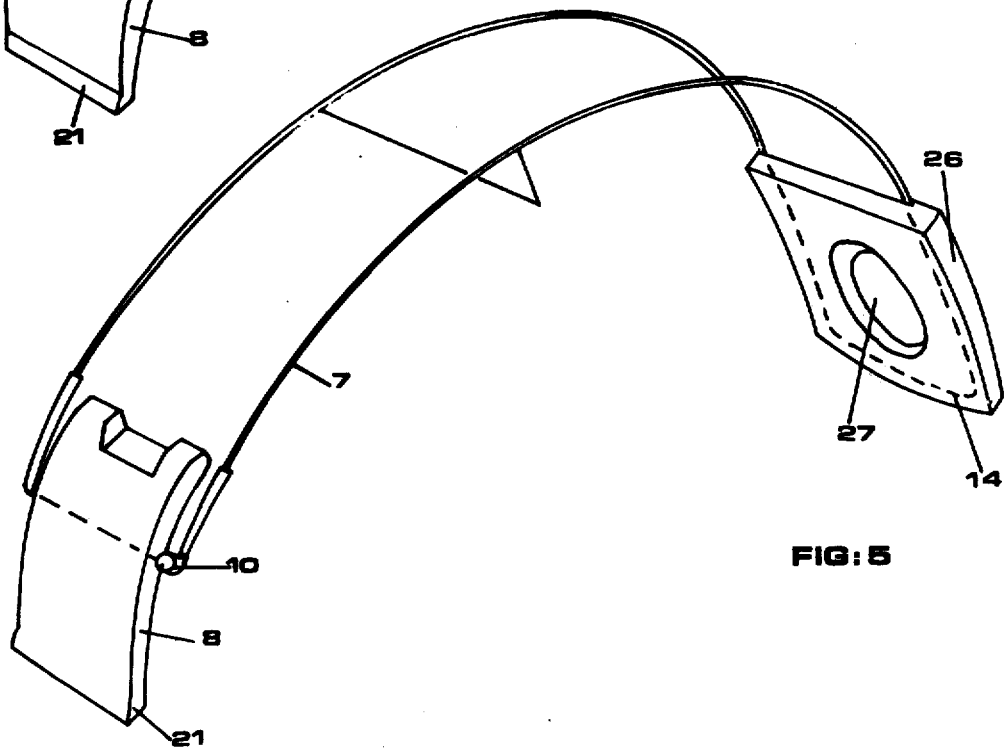

In another embodiment shown in FIGS. 4 and 5, the transverse end portion 14 of the loop 7 (see FIG. 4) is covered by a flexible ribbon or strap 23 of stainless steel which is riveted and folded back over 14 by its end 24 and the other end 25 of which is molded into a part 26, of rigid plastic material, formed with a hole 27 which is intended to be positioned over studs which have dimensions complementary to those of the hole 27, provided for this purpose on the flap portion 4 of the shell 1 and are likewise obtained directly during molding. Avantageously, this hole 27 is an ellipse and its axis is inclined.

In the variant of FIG. 5, the end 14 is directly inserted into the part 26 during molding. The loop 7 is not covered by a ribbon or strap.

As already stated, FIGS. 6 to 9 represent in detail two embodiments of the end of the lever 8 and of the fixed stop 5, respectively in a perspective view (FIGS. 6 and 8) and in side elevation (FIGS. 7 and 9), which embodiments permit the height of this stop 5, and hence the risks of catching, to be reduced. The end 11 of the lever 8 has at its center a recess 28 which advantageously is bevelled and is intended to be fixed in the notch 6. This arrangement allows a certain angular displacement of the assembly 7–8, and this is an advantage for positioning the lever 8. The length of this recess 28 is slightly greater than that of the stop 5 at the level of the transverse complementary notch 6.

In the version of FIGS. 8 and 9, the recess 28 has, furthermore, a transverse rod 29, for example of steel, which is inserted during the molding of the lever 8.

For closing the boot, it suffices to bring the end 11 of the lever 8 into contact with the lug 5 of the flap 3 and, more precisely, to engage it in the notch 5 and then to lower this lever 8 in such a way that it comes into contact with the flap 3. Under the pivoting action of the lever about the axis 10 in the notch 9, the loop 7 is tensioned since its opposite end 14 is firmly fixed to the other flap 4 of the boot either by the part 15 (FIGS. 1 to 4) or by studs (FIGS. 4 and 5). Thus, the two flaps 3 and 4 approach each other, enclose the foot, hold it and ensure leak-tightness.

Figure 11:
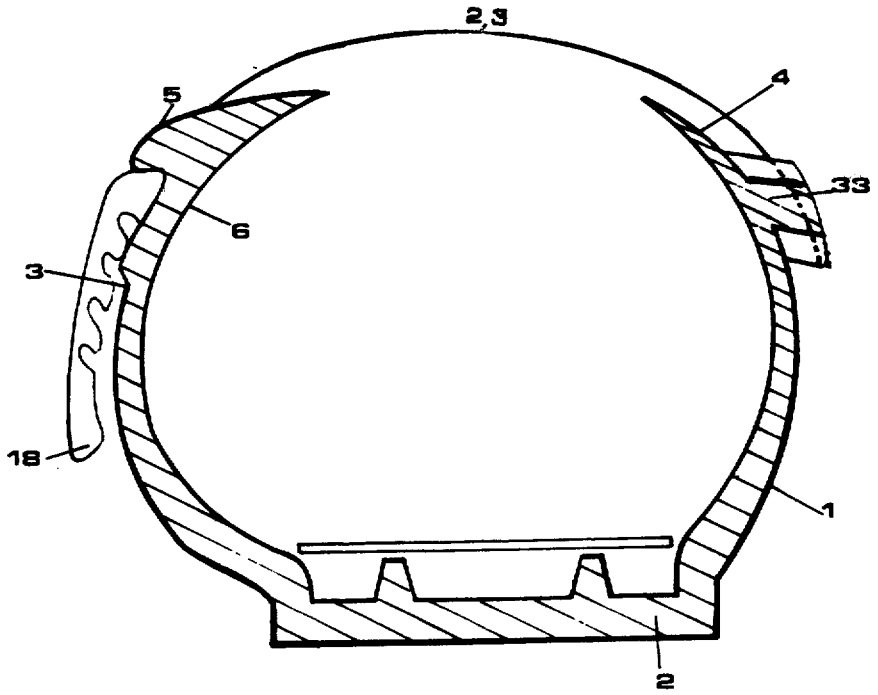

FIG. 10 shows, in perspective, another type of ski boot equipped with a closure according to the invention. Here, the shell is largely open at the front to allow the foot to be introduced, which is subsequently covered by a cap 30 pivoting towards the front 31, as indicated by the arrow. The boot likewise comprises a conventional collar 32 of injection-molded plastic material, and, on the opposite side 4 of the shell 1, studs 33 and which are intended to receive the part 26 and, more particularly, the hole 27 (FIGS. 4 and 11).

It is evident that this type of closure according to the invention can be applied to all types of boots inasmuch as, on these boots, elements are provided which make it possible, on the one hand, to provide engagement with the end of the tensioning lever and, on the other hand, to hold the opposite end of the closure element on the said boot. Furthermore, it is evident that the element is reversible, that is to say that the element forming a stop can be provided either on the lower flap or on the upper flap or, as already stated, on one side and the other of the boot.

This type of closure is particularly suitable for ski boots or mountain boots.

I claim:

1. A molded plastics material boot comprising, in combination:

a. a rigid sole;

b. a rigid shell upper integral with said sole;

c. first and second relatively movable portions of said shell upper enabling said shell upper to be closed on a wearer's foot;

d. at least one closure element for clamping said portions in a closed position, each said closure element comprising:

(i) a closed loop having first and second ends, the first end being connected to said first portion;

(ii) a lever pivotally mounted on the second end of the loop and comprising a plurality of parallel grooves formed in said lever, a transverse portion of said loop at the second end thereof engageable selectively in one of said parallel grooves to mount said lever pivotally and a flexible cover plate engaged over said grooves;

(iii) a fixed seat molded onto said second portion; and (iv) an end on said lever engageable in said fixed seat, said lever being pivotable after engagement in said seat effective to tighten said loop.

2. A molded plastics material boot comprising, in combination:

a rigid sole;

b. a rigid shell upper integral with said sole;

c. first and second relatively movable portions of said shell upper enabling said shell upper to be closed on a wearer's foot;

d. at least one closure element for clamping said portions in a closed position, each said closure element comprising:

(i) a closed loop having first and second ends, the first end being connected to said first portion;

(ii) a lever pivotally mounted on the second end of the loop;

(iii) a fixed seat molded onto said second portion;

(iv) an end on said lever engageable in said fixed seat, said lever being pivotable after engagement in said seat effective to tighten said loop; and (v) a lug molded onto said first portion, a movable stop member having a transverse slit formed therein, a transverse portion of said loop at a first end thereof engageable pivotally in said transverse slit, said stop being engageable against said lug.

3. A boot as claimed in claim 2, and further comprising a channel formed in said lug for the passage of said loop.

4. A boot as claimed in claim 1 and further comprising a recess formed in said end of said lever and a notch formed on said fixed seat, said recess having a length slightly greater than that of the seat, the notch and the recess having complimentary shapes.

5. A boot as claimed in claim 1, and further comprising a recess in said end of said lever, a notch in said fixed seat, the width of the notch being slightly greater than that of the seat, and a transverse bar in said recess adapted to engage in said notch.

6. A boot as claimed in claim 1, and comprising a stud molded onto said first part, a rigid member secured to the first end of said loop, means defining an opening in said rigid part of a size to engage over said stud.

7. A boot as claimed in claim 1, and further comprising a flexible metallic strip secured to the second end of said loop.

8. A boot as claimed in claim 1, wherein the said end of the lever is formed as a round ended lip for engagement with said fixed seat.

9. A boot as claimed in claim 1, wherein said loop is in the form of a flexible cable.

10. A boot as claimed in claim 1, and further comprising a lug molded onto said first portion, a movable stop member having transverse slit formed therein, a transverse portion of said loop a first end thereof engageable pivotally in said transverse slit, said stop being engageable against said lug.

11. A boot as claimed in claim 10, and further comprising a channel formed in said lug for the passage of said loop.

12. In a boot of the type having first and second relatively movable portions closeable over a wearer's foot, an improved closure element comprising:

a strand forming a first end and a substantially U-shaped second end, the first end being connected to the boot first portion;

a lever for holding the second end of the loop and including a plurality of spaced-apart loop holding means for holding the loop second end in different positions along the length of the lever to effect the desired tension in the loop during closure operations; and seat means formed on said boot second portion for detachably pivotally receiving an end of said lever, whereby pivoting of said lever serves to tension said loop and bring the boot first and second portions together.

13. A boot as claimed in claim 12 wherein said loop holding means comprises a plurality of substantially parallel grooves formed in one face of the lever and a cover plate engaged over the grooves.

* * * * *